United States Patent [19]

Bly

[11] Patent Number: 5,038,430

[45] Date of Patent: Aug. 13, 1991

[54] ATTACHING MEANS FOR BED CROSS BRACE

[75] Inventor: Robert R. Bly, Wellington, Ohio

[73] Assignee: Invacare Corporation, Elyria, Ohio

[21] Appl. No.: 497,421

[22] Filed: Mar. 22, 1990

[51] Int. Cl.[5] ..... A47C 21/08; B25G 3/36

[52] U.S. Cl. ..... 5/425; 5/429; 5/430; 5/200.1; 5/282.1; 403/397; 403/399

[58] Field of Search ..... 5/200.1, 282.1, 425–430, 5/508; 403/387, 395, 397, 399

[56] References Cited

U.S. PATENT DOCUMENTS

| | | | |
|---|---|---|---|
| 1,017,153 | 2/1912 | Kampe | 5/508 |
| 1,434,352 | 10/1922 | Jester . | |
| 2,817,854 | 12/1957 | Pratt | 5/428 |
| 2,871,490 | 2/1959 | Balonick . | |
| 2,968,850 | 1/1961 | Tinnerman | 24/81 |
| 3,002,200 | 10/1961 | Murcott . | |
| 3,032,781 | 5/1962 | Constanti . | |
| 3,233,297 | 2/1966 | Havener | 403/397 |
| 3,562,873 | 2/1971 | Cumber | 403/394 |
| 3,602,929 | 9/1971 | Murcott et al. | 5/429 |
| 3,624,847 | 12/1971 | Murcott et al. | 5/429 |
| 4,724,559 | 2/1988 | Bly et al. | 5/425 |

*Primary Examiner*—Michael F. Trettel

*Attorney, Agent, or Firm*—Fay, Sharpe, Beall, Fagan, Minnich & McKee

[57] ABSTRACT

A bed side-guard assembly for a bed with bed frame memebrs comprises a side rail which extends generally along the length of the bed in the vertical plane. The side rail is supported by downwardly depending legs. A cross brace extends generally across the width of the bed in the horizontal plane. The ends of the cross brace have receiving means to receive the side rail legs. Attaching means for securing the cross brace to the bed frame members are mounted on each end of the cross brace. The attaching means includes a housing and resilient means. The housing features a nose end which fits beneath a portion of the bed frame member while the resilient means grippingly engages the bed frame member between the nose end and the resilient means.

13 Claims, 4 Drawing Sheets

ATTACHING MEANS FOR BED CROSS BRACE

BACKGROUND OF THE INVENTION

1. Field of the Invention

The present invention relates to attaching means for cross braces for beds featuring bed frame members. More particularly, the invention relates to an attaching means for attaching cross braces to bed frame members.

2. Description of Related Art

In the art of bed frame design, it is known to support the bedding material by bed frame members running on either side of the bed, from the headboard to the footboard. U.S. Pat. No. 3,032,781 to Constanti discloses a safety side-guard rail which is mounted to an end frame at opposite sides of the bed. Brackets are attachable to the end frames and provide support for the guide rods. Further, U.S. Pat. No. 4,724,559 to Bly, et al. discloses a bed rail whose ends are received in brackets. The brackets are attached to the cross members of the bed. While the afore-mentioned structure has been effective, it requires assembly of several parts in order to fix the side rails, brackets, and cross members to the bed frame members.

In art areas other than the bed frame art, U.S. Pat. No. 2,968,850 to Tinnerman discloses a clamp capable of securement to a rod or wire without the need for additional fasteners. Further, U.S. Pat. No. 1,434,352 to Jester discloses a building construction clip for locking together two perpendicular rods. The clip operates without the need for additional fasteners.

A need was perceived in the bed art for a low-cost, simple attaching means to attach a cross brace to a bed frame member. The present invention is directed to this objective and provides a reliable and easily used method of securely fastening a cross brace to a bed frame member.

SUMMARY OF THE INVENTION

In accordance With one aspect of the present invention, a bed side-guard assembly for a bed with bed frame members comprises a side rail extending generally along the length of the bed in the vertical plane. The side rail has at least one leg depending downwardly from the side rail. A cross brace, having at least two ends, extends generally across the width of the bed in the horizontal plane. At least one end of the cross brace has receiving means to receive the side rail leg. An attaching means for securing the cross brace to the bed frame member is fixedly attached to the cross brace and includes a resilient means and a nose end. The attaching means is operatively associated with the bed frame member where the bed frame member is gripped between the nose end and the resilient means.

In accordance with another aspect of the invention, the bed frame member is gripped between the nose end and the resilient means without the need for additional fasteners.

In accordance with a further aspect of the invention, the resilient means has a spring clip.

In accordance with still another aspect of the invention, the attaching means comprises a housing having a nose end and a resilient means, the housing adapted to receive the cross brace therethrough.

In accordance with another aspect of the invention, the attaching means comprises a housing having a top portion and a bottom portion. The top portion of the housing is adapted to selectively receive the cross brace therethrough. The bottom portion of the housing comprises two runners, each runner having a nose end and a top edge. The nose end of each runner is adapted to selectively be fitted beneath a bed frame member. The attaching means also comprises a spring clip. The spring clip has a body portion and a gripping portion. The body portion has a void adapted to receive the top portion of the housing, the top portion of the housing adapted to fit through the void and the spring clip resting on the top edge of the runners. The gripping portion of the spring clip is adapted to operatively engage the bed frame members where, when the nose end of the runners are fitted beneath a bed frame member, the spring clip gripping portion can be resiliently flexed over a corner of the bed frame member to grippingly secure the attaching means and cross brace to the bed frame member.

In accordance with another aspect of the invention, a method of securing a telescoping cross brace to a pair of bed frame members, where the telescoping cross brace has a first and second end and comprises a first tube and a second tube in which the first tube first slidingly receives a portion of the second tube and also comprising attaching means located near each end of the cross brace, the method comprising the steps of snapping one attaching means to one bed frame member, adjusting the length of the telescoping cross brace to fit the distance between the bed rails, positioning the second attaching means over the second bed frame member, and snapping the second attaching means to the second bed frame member.

In accordance with still a further aspect of the invention, a bed side-guard assembly for a bed with bed frame members comprises a side rail extending generally along the length of the bed in the vertical plane. The side rail has at least two legs with at least one leg downwardly depending from the side rail. A cross brace extends generally across the width of the bed in the horizontal plane. The side-guard assembly also includes a first and second attaching means for securing the cross brace to the bed frame member. The first attaching means is fixedly attached to the first end of the first tube. The first attaching means includes a first resilient means and a first nose end. The second attaching means is fixedly attached to the first end of the third tube and includes a second resilient means and a second nose end. Each attaching means is operatively associated with the bed frame members where each nose end slides snugly under a bed frame member and each resilient means grippingly engages an opposite surface of the bed frame member.

In accordance with a further aspect of the invention, a bed side guard assembly for a bed with bed frame members comprises a side rail extending generally along the length of the bed in the vertical plane. The side rail has at least one leg depending downwardly from the side rail. A cross brace, having at least two ends, extends generally across the width of the bed in the horizontal plane. At least one end of the cross brace has receiving means to receive the side rail leg. The cross brace comprises a first and second tube, the first tube adapted to slidingly receive a portion of the second tube. An attaching means for securing the cross brace to the bed frame member is fixedly attached to the cross brace and includes a resilient means and a nose end. The attaching means is operatively associated with the bed frame member where the bed frame member is gripped between the nose end and the resilient means.

In accordance with a further aspect of the invention, a bed side-guard assembly for a bed with bed frame members comprises a side rail extending generally along the length of the bed in the vertical plane. The side rail has at least two legs with at least one leg downwardly depending from the side rail. A cross brace extends generally across the width of the bed in the horizontal plane. The cross brace comprises a first, second, and third tube, each tube having a first and second end. The second end of the first tube is adapted to slidingly receive the first end of the second tube. The second end of the first tube is adapted to slidingly receive the second end of the second tube. The side-guard assembly also includes a first and second attaching means for securing the cross brace to the bed frame member. The first attaching means is fixedly attached to the first end of the tube. The first attaching means includes a first resilient means and a first nose end. The second attaching means is fixedly attached to the first end of the third tube and includes a second resilient means and a second nose end. Each attaching means is operatively associated with the bed frame members where each nose end slides snugly under a bed frame member and each resilient means grippingly engages an opposite surface of the bed frame member.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DESCRIPTION OF THE PREFERRED EMBODIMENT

Figure 1:
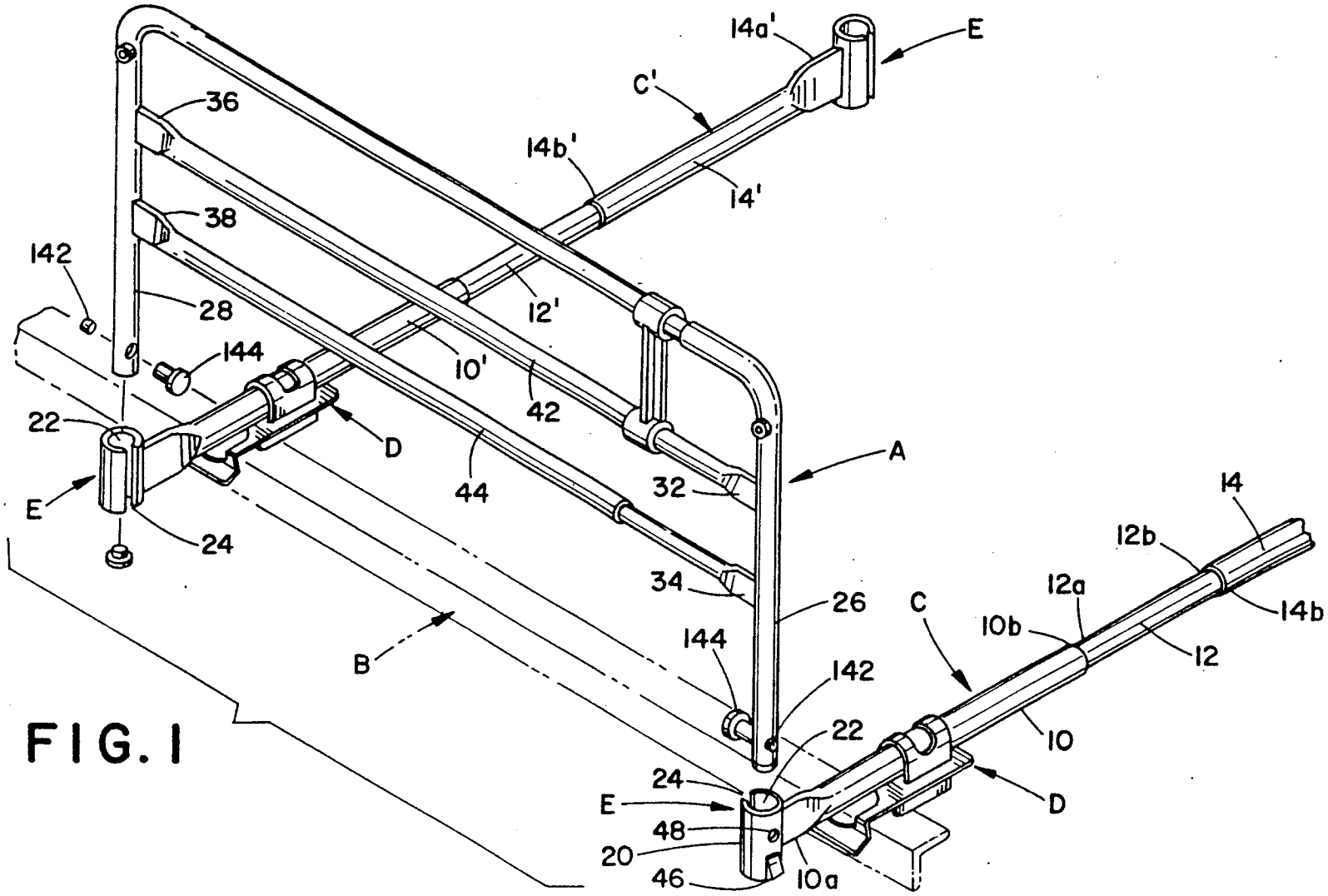
FIG. 1 is a perspective view of the bed side-guard assembly, showing the bed frame member, bed side rail, two cross braces, and attaching means.

Referring now to the drawings wherein the showings are for purposes of illustrating a preferred embodiment of the invention only and not for purposes of limiting same, FIG. 1 shows a bed side rail A. Typically, one such bed side rail will run longitudinally along either side of a bed to prevent the patient from falling from the bed to the floor below and sustaining an injury. Also shown is a bed frame member B. Typically one such bed frame member extends on either side of the bed between the headboard and the footboard of the bed and supports the weight of the mattresses, bedding, and the patient. Cross braces C extend between each bed frame member and support the bed side rails. Attaching means D secure the cross brace to the bed frame member.

It is desirable to assemble and disassemble a bed with a minimum of effort, time, and tools required. Additionally, in a hospital or nursing home environment, loose parts required for the bed assembly can be easily misplaced, adding to the difficulties in assembling and disassembling the bed. The present invention concerns a low-cost and effective apparatus which requires no additional tools and has no loose parts that are necessary to effectively assemble or disassemble the bed.

With continuing reference to FIG. 1, there is disclosed a pair of cross braces C, C'. In the preferred embodiment, each cross brace comprises a first, second, and third tube 10, 10', 12, 12', 14, 14'. The first tube 10 of one cross brace C is identical to the third tube 14' of the other cross brace C'. Similarly, the third tube 14 of one cross brace C is identical to the first tube 10' of the other cross brace C'. To facilitate description of the preferred embodiment, only one of the two like cross braces will be described in detail and it will be appreciated that the description applies to both. The first end **12*a* of the second tube 12 is adapted to be slidingly received within the second end 10*b* of the first tube 10. Likewise, the second end 12*b* of the second tube 12 is adapted to be slidingly received within the second end 14*b* of the third tube 14**.

Figure 8:
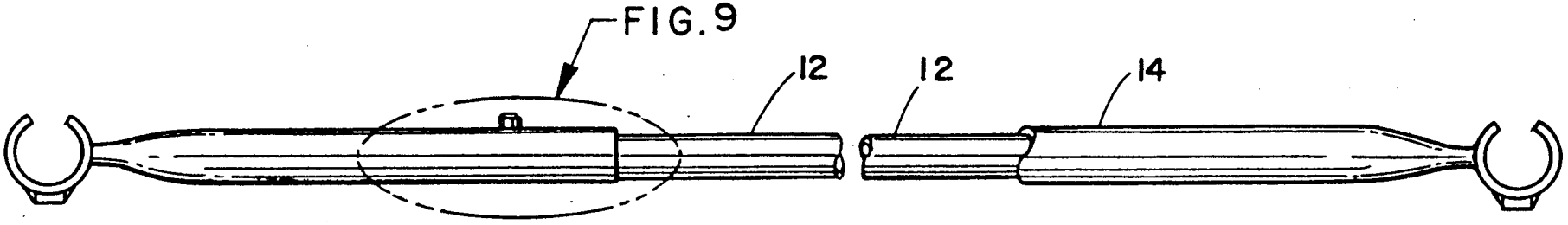
FIG. 8 is a plan view of the second tube of the cross brace according to one embodiment of the invention; and, FIG. 9 is a cross-sectional side view of the second tube of the cross brace and of the locking button and release spring.
Figure 9:
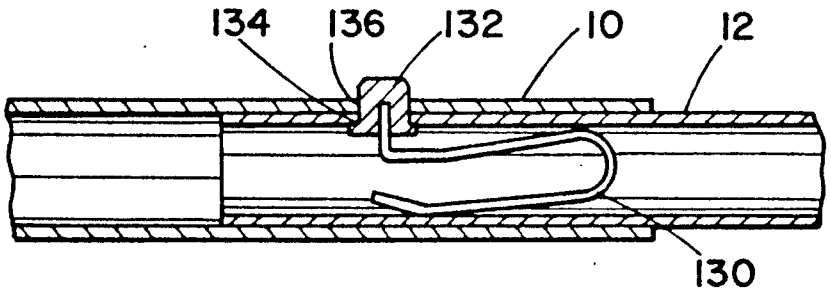

As seen in FIGS. 8 and 9, the second tube 12 has a locking means within it to prohibit relative movement between the first tube 10 and the second tube 12. In the preferred embodiment, the locking means is a release spring 130 and locking button 132. The second tube 12 has a corresponding hole 134 which selectively receives the locking button 132. The first tube 10 also has a hole 136 which is similar to the hole 134 in the second tube. With reference to FIGS. 1 and 9, when the first end **12*a* of the second tube 12 is slidingly received within the second end 10*b* of the first tube 10, the hole 134 in the second tube is aligned with the hole 136 in the first tube 10. The release spring 130 will cause the locking button 132 to protrude through both of the aligned holes 134, 136 and prevent relative motion between the first tube 10 and the second tube 12. In an alternate but essentially equivalent embodiment, the hole in the first tube 10 could have been located in the third tube 14, thereby preventing relative movement between the second and third tubes 12, 14. It is not important whether movement is prohibited between the second tube 12 and the first or third tubes 10, 14. As long as the second tube 12 is fixed relative to the first or third tubes 10, 14**, the invention may be practiced.

With reference to FIG. 9, although simultaneous sliding movement between all three tubes 10, 12, 14 is not desired, movement is desirable between two of the three tubes. In other words, movement is desirable between the second tube 12 and the first or third tube 10, 14. The fact that the second and third tubes 12, 14, or second and first tubes 12, 10, slide relative to each other offers two advantages. First, the cross brace C can be adapted to beds of various widths. Second, one end of one bed side rail A can be lowered without simultaneously lowering the other end. With reference to FIG. 1, in order to lower just one end of the bed side rail A, the bracket E, as well as the first tube 10, must rotate relative to the other bracket and other end of the cross brace, i.e., the third tube 14. As detailed later, lowering just one end of a bed side rail requires that the first and third tubes 10, 14 must also rotate relative to the attaching means D.

While, in the preferred embodiment, the cross braces C are comprised of three pieces and are telescoped in the manner described above, this feature is not necessary to practice the invention. The invention can also be practiced in a one or two piece cross brace.

With continuing reference to FIG. 1, at the first end 10*a* of the first tube 10 and at the first end (not shown) of the third tube (not shown) is fixedly mounted a bracket E. The bracket comprises a sleeve 20 which is generally C-shaped in cross section and defines a slide passage 22 therethrough. A lower end of each leg 26, 28 of the bed side rail is slidably received in the slide passage. Various styles of telescoping side rails, including half side rails, may be received by the bracket. In one embodiment of a half side rail, the bed side rail extends from near the headboard to the middle of the bed. A vertical slot 24 in the sleeve 20 extends between the slide passage 22 and an exterior of the sleeve 20. The slot 24 is dimensioned with an appropriate width to receive the reduced width end portions 32, 34 and 36, 38 of the cross members 42, 44 diametrically opposite from the slot. In the preferred embodiment, the bracket E defines a cam surface and a locking aperture 48. The bracket is fixedly mounted to the first end 10*a* of the first tube 10 and the first end 14*a* of the third tube 14.

Figure 2:
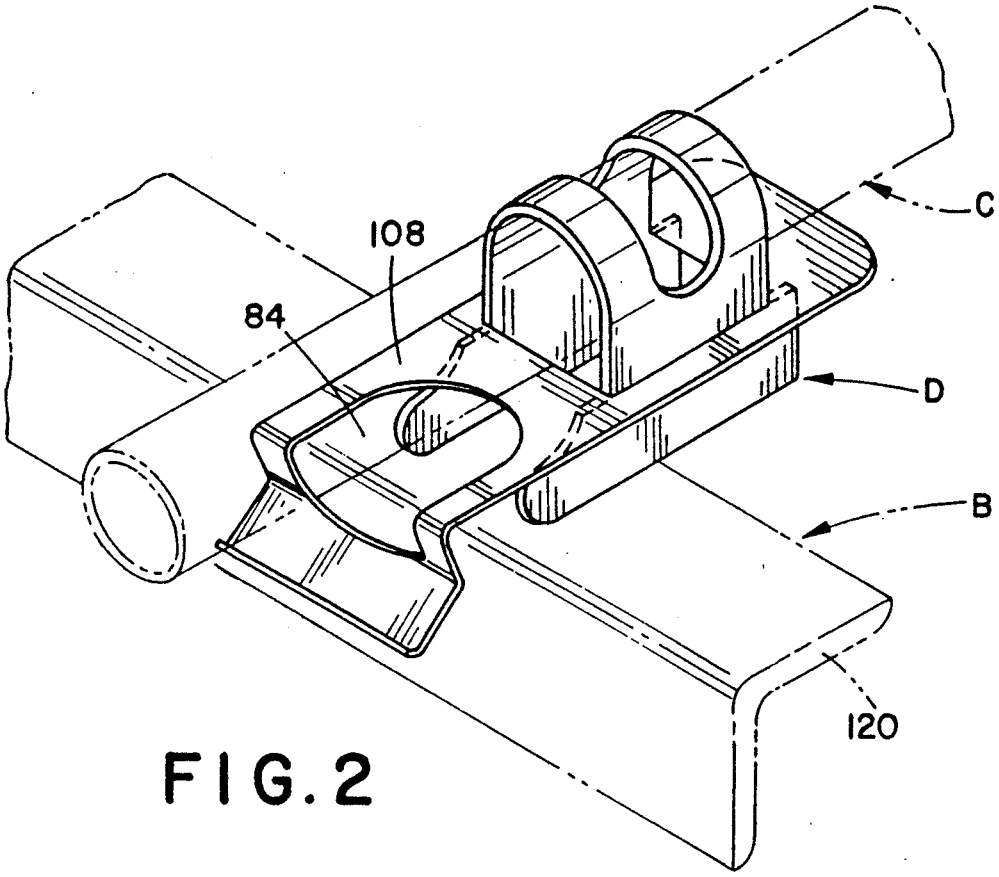
FIG. 2 is an enlarged perspective view of the attaching means of FIG. 1.
Figure 3:
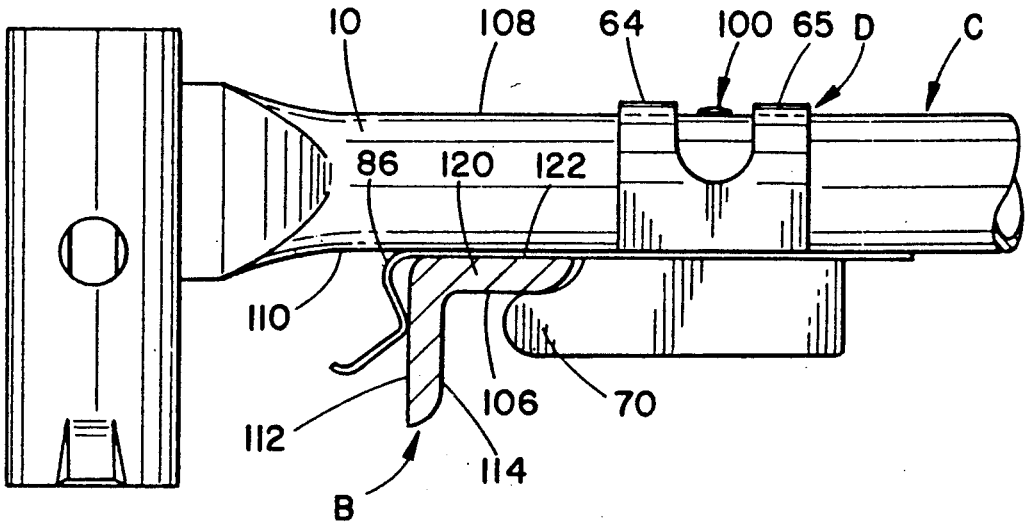
FIG. 3 is a side view of the attaching means grippingly engaging the bed frame member.

With reference to FIGS. 1, 2, and 3, bed frame member B is shown. In FIG. 3, the bed frame member is shown in cross section. The bed frame members are commonly made of "angle iron". The term "opposite", as in "opposite surface of the bed frame" means two surfaces separated by a portion of the bed frame member. For example, in FIG. 3, surfaces 112 and 114, and 106 and 122 are examples of opposite surfaces. Surfaces 106 and 114 are not opposite surfaces.

As seen best in FIGS. 2 and 3, the attaching means D operates to selectively attach the cross brace C to the bed frame member B. The attaching means is comprised of two elements, a housing and a resilient means. One attaching means is fixedly attached to each end of each cross brace C.

Figure 4:
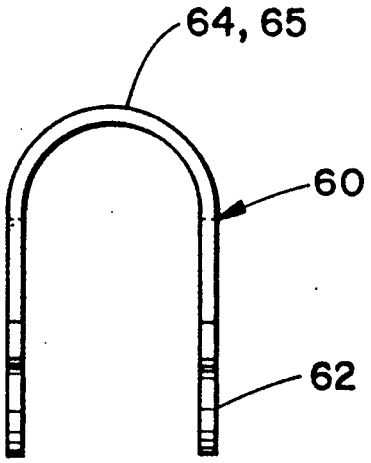
FIG. 4 is an end view of the housing.
Figure 5:
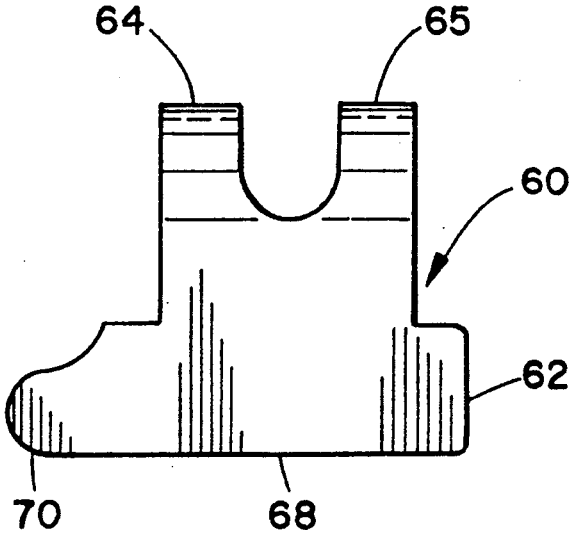
FIG. 5 is a side view of the housing.

As seen best in FIGS. 4 and 5, the housing comprises a top portion 60 and a bottom portion 62. With reference to FIG. 4, the top portion 60 of the housing is formed in an arch shape. As seen best in FIG. 2, the radius of the arch is chosen to allow the cross brace C to fit through the top portion of the housing.

With reference to FIGS. 2 and 5, the bottom portion 62 of the housing comprises two runners, similar to runners on a sled. The nose end 70 of one end of each runner slopes downwardly toward the bottom edge 68 of the housing.

Figure 6:
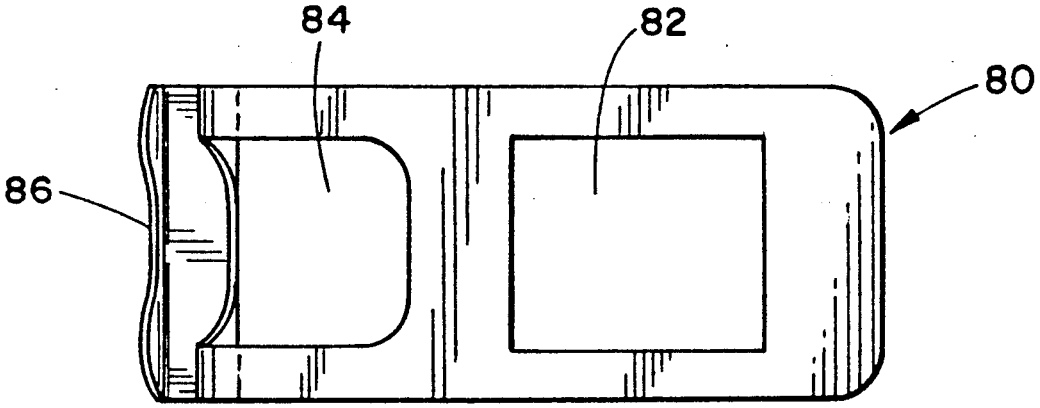
FIG. 6 is a plan view of the spring clip.
Figure 7:
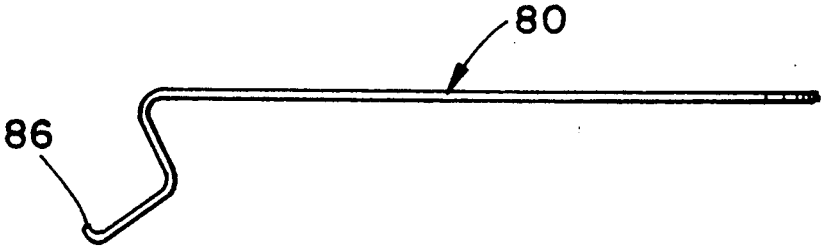
FIG. 7 is a side view of the spring clip.

The attaching means D also comprises a gripping portion in the form of a resilient means 80. In the preferred embodiment, the resilient means is a spring clip. With reference to FIGS. 6 and 7, the spring clip has a first void 82 and a second void 84 therethrough. The first void 82 is adapted to receive the top portion of the housing 60 therethrough, as seen best in FIGS. 2 and 3. A first end 86 of the resilient means 80 is formed to selectively engage the corner of the bed frame B. The second void 84 is adapted to fit around the first tube 10 when the first end 86 of the resilient means is deflected upwardly, such as when disassembling the bed. The operation of the attaching means will be more fully explained later.

With reference to FIGS. 3 and 5, a rivet 100 is mounted through the outer wall of the respective ends 10*a*, 14*a* of the of the first and third tubes 10, 14. This rivet 100 is located between the arches 64, 65 of the housing 60. The rivet acts to lock the attaching means D to the cross brace C while allowing the cross brace C to rotate relative to the attaching means D. As discussed previously, this rotation is necessary whenever only one end of the bed side rail A is lowered.

With reference to FIGS. 2 and 3, the operation of the attaching means D is as follows. When a bed is to be assembled, and the cross brace C is to be attached, the nose end 70 of a attaching means D is fitted under the horizontal leg 120 of the bed frame member B. Downward pressure is applied on the top surface 108 of the cross brace C. The downward pressure causes the first end 86 of the spring clip 80 to deform outwardly, allowing the upper surface 122 of the horizontal leg 120 of the bed frame member B to lie adjacent the bottom surface 110 of the cross brace C. The deformation of the resilient means 80 is within its elastic limit, allowing the resilient means 80 to snap back to a position of less deformation. Due to the elastic deformation of the resilient means 80, compressive force is applied on the vertical surface 112 and the upper surface 122 of the horizontal leg 120 of the bed frame member B, thereby grippingly engaging the bed frame member B between the nose end 70 of the attaching means D and the first end 86 of the resilient means 80.

With continuing reference to FIGS. 2 and 3, when a bed is to be disassembled, or the attaching means D removed for any other reason, the first end 86 of the resilient means 80 is deflected upwardly. Depending on which end of the cross brace C is under consideration, the first or third tube 10, 14 is received into the second void 84 as the first end 86 of the resilient means 80 deflects upwardly. With the compressive force on the vertical surface 112 and the upper surface 122 of the horizontal leg 120 of the bed frame member B thereby removed, the attaching means D and the cross brace C can be removed from the bed frame member B.

With reference to FIG. 1, the procedure to raise or lower a bed side rail is as follows. A spring-biased member 142 is attached to a knob 144. The spring-biased member 142 is selectively received within locking aperture 48. The spring-biased member 142 is withdrawn from the locking aperture 48 by means of the knob 144. This allows the leg 26, 28 to slide through the slide passage 22. The slot 24 receives spring-biased member 142 as well as the reduced width end portions 32, 34 and 36, 38 of the cross members 42, 44. If just one leg is lowered, rotation occurs between the first tube 10 and the attaching means D and between the second tube 12 the third tube 14.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A bed side-guard assembly for a bed with bed frame members, the bed side-guard assembly comprising:

a side rail extending generally along the length of the bed in the vertical plane, the side rail having at least one leg downwardly depending from the side rail;

a cross brace extending generally across the width of the bed in the horizontal plane, the cross brace having two ends, at least one end of the cross brace having receiving means to receive the side rail leg; and, attaching means for securing the cross brace to the bed frame member, the attaching means fixedly attached to the cross brace, the attaching means including a resilient means and a nose end, the attaching means operatively associated with the bed frame member where the bed frame member is gripped between the nose end and the resilient means by deflection of the resilient means.

2. A bed side-guard assembly as in claim 1 wherein the resilient means is a spring clip.

3. A bed side-guard assembly as in claim 1 wherein the attaching means comprises:

a housing, the housing having top portion and a bottom portion, the top portion adapted to selectively receive the cross brace therethrough, the bottom portion comprising two runners, each runner having a nose end, and a top edge, the nose end adapted to selectively be fitted beneath a bed frame member; and, a spring clip, the spring clip having a body portion and an a gripping portion, the body portion having a first void adapted to receive the top portion of the housing, the top portion of the housing fitting through the first void and the spring clip resting on the top edge of the runners, the gripping portion adapted to operatively engage the bed frame members where, when the nose ends of the runners are fitted beneath a bed frame member, the spring clip gripping portion can be resiliently flexed over a corner of the bed frame member to grippingly secure the attaching means and cross brace to the bed frame member.

4. A bed side-guard assembly as in claim 3 wherein the spring clip further comprises a second void, the second void adapted to selectively receive the cross brace therethrough when the spring clip gripping portion is resiliently flexed upward away from the bed frame member.

5. A bed side-guard assembly as in claim 1 wherein the attaching means comprises;

a housing, the housing having a top portion and a bottom portion, the top portion adapted to selectively receive the cross brace therethrough, the bottom portion comprising two runners, each runner having a nose end, and a top edge, the nose end adapted to selectively be fitted beneath a bed frame member; and, a spring clip, the spring clip having a body portion and a gripping portion, the gripping portion adapted to operatively engage the bed frame members where, when the nose ends of the runners are fitted beneath a bed frame member, the spring clip gripping portion can be resiliently flexed over a corner of the bed frame member to grippingly secure the attaching means and the cross brace to the bed frame member, the body portion having a void adapted to selectively receive the cross brace therethrough when the spring clip gripping portion is resiliently flexed upwardly away from the bed frame member.

6. A bed side-guard assembly as in claim 5 wherein the spring clip further comprises a second void, the second void adapted to receive the top portion of the housing, the top portion of the housing fitting through the second void and the spring clip resting on the top edge of the runners.

7. A method of securing a telescoping cross brace to a pair of bed frame members, the telescoping cross brace having a first and second end and comprising a first tube and a second tube, the first tube slidingly receiving a portion of the second tube, and attaching means comprising resilient members located near each end of the cross brace, the method comprising the steps of:

snapping a first attaching means to a first bed frame member by deforming a first resilient member over the first bed frame member;

adjusting the length of the telescoping cross brace by telescoping the cross brace tubes;

positioning a second attaching means over a second bed frame member; and, snapping the second attaching means to the second bed frame member by deforming a second resilient member over the second frame member.

8. A bed side-guard assembly for a bed with bed frame members, the bed side-guard assembly comprising:

a side rail extending generally along the length of the bed in the vertical plane, the side rail having at least two legs, downwardly depending from the side rail;

a cross brace extending generally across the width of the bed in the horizontal plane, the cross brace comprising a first, second, and third tube, each tube having a first and second end, the second end of the first tube is adapted to slidingly receive the first end of the second tube, the second end of the third tube adapted to slidingly receive the second end of the second tube; and, a first and second attaching means for securing the cross brace to the bed frame member, the first attaching means fixedly attached to the first end of the first tube, the first attaching means including a first resilient means and a first nose end, the second attaching means fixedly attached to the first end of the third tube, the second attaching means including a second resilient means and a second nose end, each attaching means operatively associated with the bed frame members where each nose end slides snugly under a first surface of the bed frame member and each resilient means grippingly engages an opposite surface of the bed frame member by being resiliently deflected over the bed frame member.

9. A bed side-guard assembly for a bed with bed frame members, the bed side-guard assembly comprising:

a side rail extending generally along the length of the bed in the vertical plane, the side rail having at least one leg downwardly depending from the side rail;

a cross brace extending generally across the width of the bed in the horizontal plane, the cross brace having two ends, at least one end of the cross brace having receiving means to receive the side rail leg; and, attaching means for securing the cross brace to the bed frame member, the attaching means fixedly attached to the cross brace, the attaching means including a resilient means and a nose end, the attaching means operatively associated with the bed frame member where the bed frame member is compressively gripped between the nose end and the resilient means by resilient deflection of the resilient means.

10. A bed side-guard assembly for a bed with bed frame members, the bed side-guard assembly comprising:

a side rail extending generally along the length of the bed in the vertical plane, the side rail having at least one leg downwardly depending from the side rail;

a cross brace extending generally across the width of the bed in the horizontal plane, the cross brace having two ends, at least one end of the cross brace having receiving means to receive the side rail leg; and, attaching means for securing the cross brace to a bed frame member, the attaching means fixedly attached to the cross brace, the attaching means including rotation means for permitting rotation of the cross brace about its axis relative to the bed frame, said rotation effective to allow only one end of said side rail to be lowered.

11. A bed ride rail assembly as in claim 10 wherein the rotation means for permitting rotation comprises:

the attaching means including a hole and a slot therein, the cross brace rotatably received through the hole; and, a button on the cross brace, the button slidingly received within the slot, thereby allowing rotation of the cross brace in one plane within the attaching means.

12. A bed side rail assembly as in claim 11 wherein the slot is of such length to allow rotation of the cross brace in two directions within one plane, thereby allowing the attaching means to be used at either end of the cross brace.

13. A bed side-guard assembly for a bed with bed frame members, the bed side-guard assembly comprising:

a side rail extending generally along the length of the bed in the vertical plane, the side rail having at least one leg downwardly depending from the side rail;

a cross brace extending generally across the width of the bed in the horizontal plane, the cross brace having two ends, at least one end of the cross brace having receiving means to receive the side rail leg; and, attaching means for securing the cross brace to the bed frame member, the attaching means fixedly attached to the cross brace, the attaching means including a resilient means and a nose end, the attaching means operatively associated with the bed frame member where an inward side and an outward side of the bed frame member are gripped between the nose end and the resilient means.

* * * * *